US007988321B2

(12) United States Patent
Wung et al.

(10) Patent No.: US 7,988,321 B2
(45) Date of Patent: Aug. 2, 2011

(54) LED LAMP

(75) Inventors: Shih-Hsun Wung, Taipei Hsien (TW); Yong-Dong Chen, Shenzhen (CN); Ye-Ke Xie, Shenzhen (CN)

(73) Assignees: Fu Zhun Precision Industry (Shen Zhen) Co., Ltd., Shenzhen, Guangdong Province (CN); Foxconn Technology Co., Ltd., Tu-Cheng, New Taipei (TW)

( * ) Notice: Subject to any disclaimer, the term of this patent is extended or adjusted under 35 U.S.C. 154(b) by 262 days.

(21) Appl. No.: 12/391,175

(22) Filed: Feb. 23, 2009

(65) Prior Publication Data

US 2010/0097804 A1 Apr. 22, 2010

(30) Foreign Application Priority Data

Oct. 21, 2008 (CN) ..... 2008 1 0305066

(51) Int. Cl.
*F21V 29/00* (2006.01)

(52) U.S. Cl. ..... 362/218; 362/249.02; 362/294

(58) Field of Classification Search ..... 362/147, 362/218, 240, 249.02, 249.14, 285, 294, 362/311.02, 364, 373, 432
See application file for complete search history.

(56) References Cited

U.S. PATENT DOCUMENTS

| | | | | |
|---|---|---|---|---|
| 7,796,208 | B2 * | 9/2010 | Ho et al. | 362/285 |
| 2002/0196623 | A1 * | 12/2002 | Yen | 362/294 |
| 2006/0187660 | A1 * | 8/2006 | Liu | 362/294 |
| 2006/0279946 | A1 * | 12/2006 | Park et al. | 362/240 |

* cited by examiner

*Primary Examiner* — Y My Quach Lee
(74) *Attorney, Agent, or Firm* — Frank R. Niranjan

(57) ABSTRACT

An LED lamp includes a bracket, two guiding plates and a number of LED assemblies. Each of the guiding plates includes a body, a top flange and a bottom flange extending from top and bottom edges of the body, respectively. The bottom flanges are mounted on opposite sides of the bracket. The top flanges are oriented towards each other. The LED assemblies are mounted to the bracket and sandwiched between the bodies of the guiding plates. The LED assemblies slide along a longitudinal direction of the guiding plates before the LED assemblies are assembled to the bracket by screwing the LED assemblies to the guiding plates. The quantity of the LED assemblies assembled to the bracket is selective thereby to meet different luminous density requirements/specifications.

14 Claims, 6 Drawing Sheets

LED LAMP

BACKGROUND OF THE INVENTION

1. Field of the Disclosure

The disclosure relates to LED lamps, and more particularly to an LED lamp having a number of LED modules which can be easily assembled to the LED lamp in a selective manner to meet different luminous intensity requirements/specifications.

2. Description of related art

The technology of LEDs has rapidly developed in recent years from indicators to illumination applications. With the features of long-term reliability, environment friendliness and low power consumption, the LED is viewed as a promising alternative for future lighting products.

A conventional LED lamp comprises a heat sink and a number of LED modules having LEDs attached to an outer surface of the heat sink to dissipate heat generated by the LEDs. The LED modules need to be totally mounted to the LED lamp; otherwise, an aesthetic appearance of the LED lamp will be unfavorably affected. Furthermore, the LED modules cannot be easily mounted to the LED lamp in a selective manner. Thus, a luminous intensity of the LED lamp cannot be changed to meet different requirements/specifications. Generally, when it is necessary to change the luminous intensity, it requires to mount the LED lamp with LED modules having a different luminous intensity, which is time-consuming, laborious and unfavorable for inventory management.

What is needed, therefore, is an LED lamp having a number of LED modules which can be easily assembled to the LED lamp in a selective manner to meet different luminous intensity requirements/specifications.

BRIEF DESCRIPTION OF THE DRAWINGS

Many aspects of the present embodiments can be better understood with reference to the following drawings. The components in the drawings are not necessarily drawn to scale, the emphasis instead being placed upon clearly illustrating the principles of the present embodiments. Moreover, in the drawings, like reference numerals designate corresponding parts throughout the several views.

DETAILED DESCRIPTION OF THE DISCLOSURE

Figure 1:
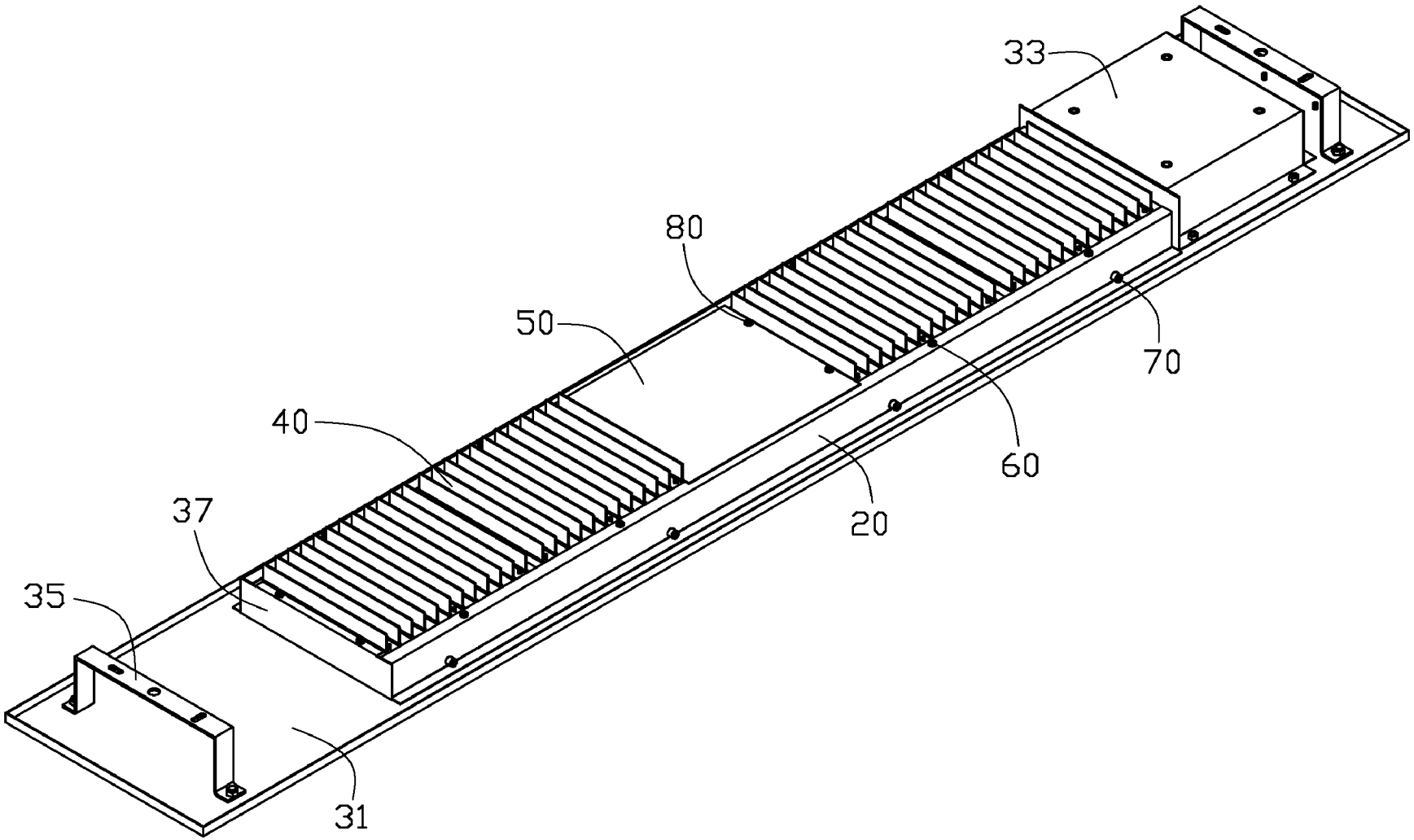
FIG. 1 is an assembled view of an LED lamp in accordance with a first embodiment of the disclosure.
Figure 2:
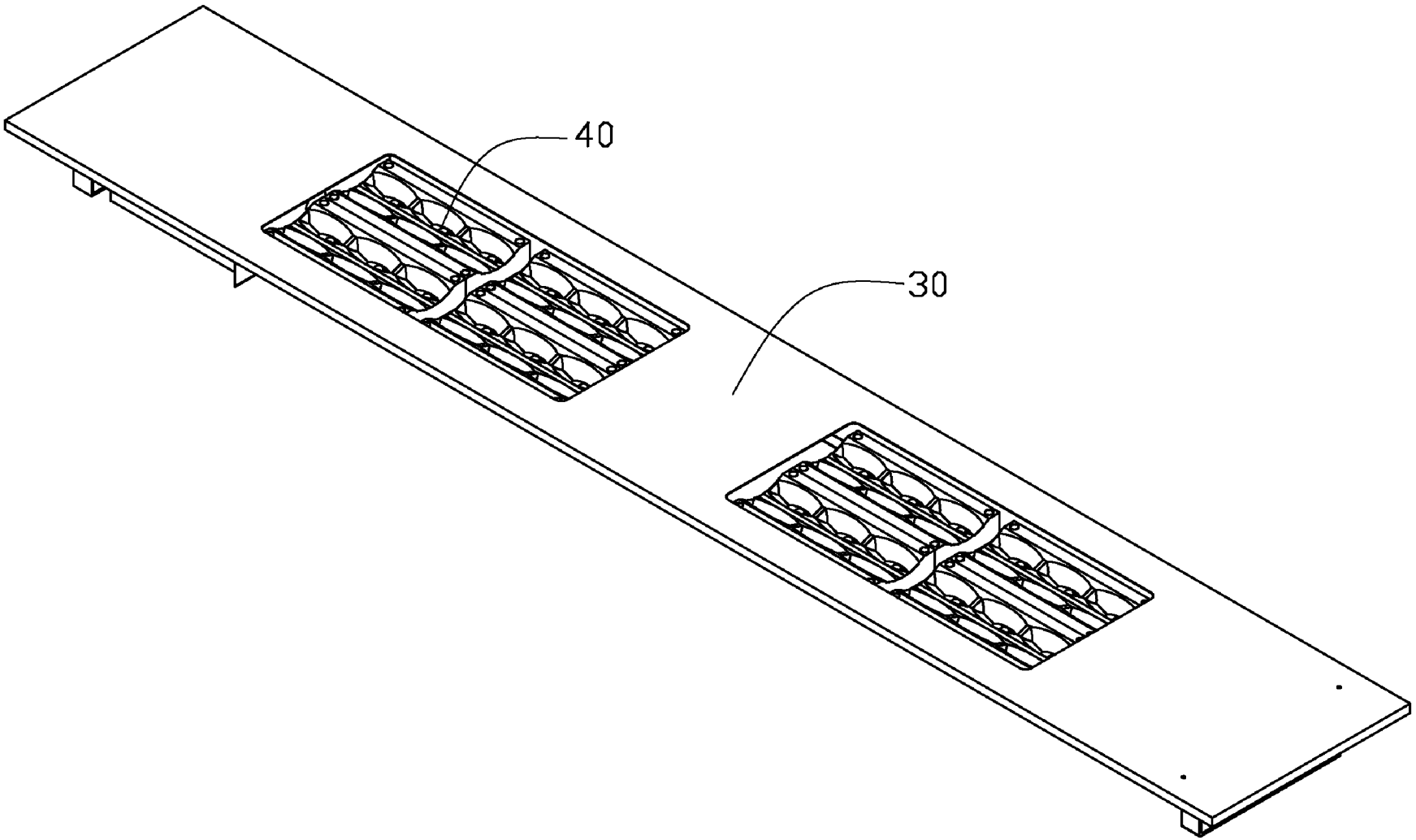
FIG. 2 is an inverted view of the LED lamp in FIG. 1.
Figure 3:
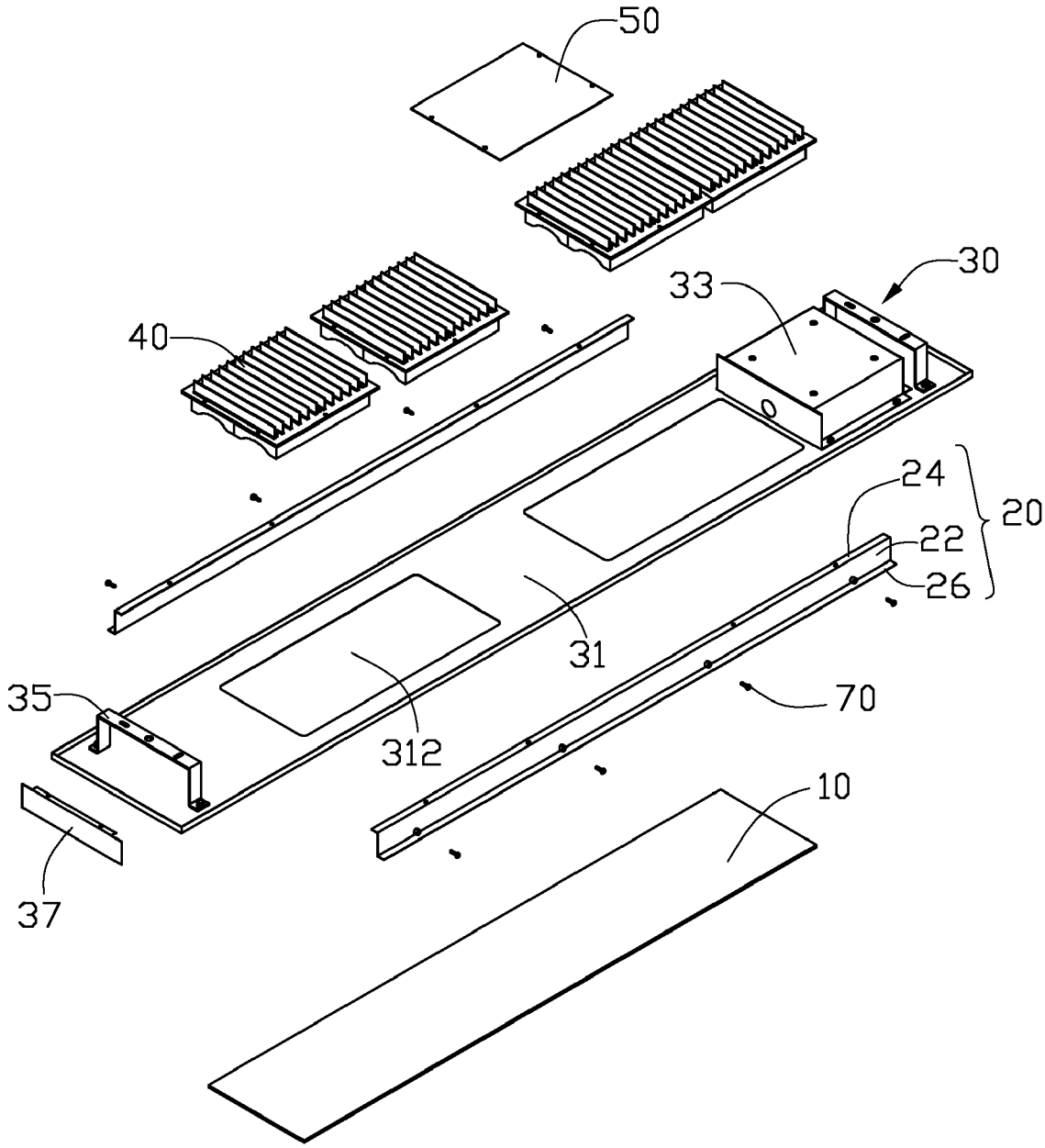
FIG. 3 is an exploded view of the LED lamp in FIG. 1.

Referring to FIGS. 1-3, an LED lamp of a first embodiment comprises a bracket 30, two guiding plates 20 mounted on two opposite sides of a top face of the bracket 30 and spaced from each other, four LED assemblies 40 mounted to the top face of the bracket 30 and sandwiched between the two guiding plates 20, an elongated, transparent cover 10 mounted to a bottom face of the bracket 30 and covering undersides of the four LED assemblies 40, and a rectangular plate 50 mounted on the guiding plates 20 and located to divide the LED assemblies 40 into two groups each including two LED assemblies 40 connected end-to-end.

Particularly referring to FIG. 3, the bracket 30 comprises an elongated mounting plate 31. The mounting plate 31 defines two spaced, rectangular openings 312 in a center portion thereof to expose the undersides of the LED assemblies 40. Each opening 312 corresponds to two adjacent LED assemblies 40. A width of the opening 312 is similar to a width of the LED assembly 40 and a length of the opening 312 is similar to a length of two LED assemblies 40 in combination. Light emitted from the two adjacent LED assemblies 40 radiates downwardly through the opening 312 and the transparent cover 10 to illuminate the environment. A driving circuit module 33 is mounted on a right end of the mounting plate 31 for driving the LED assemblies 40 to lighten. A baffling plate 37 is mounted on a left end of the mounting plate 31 to engage with the guiding plates 20 after the LED assemblies 40 are assembled to the bracket 30. Two U-shaped securing plates 35 are mounted on opposite, lateral ends of the mounting plate 31 for mounting the LED lamp on a determined place such as a ceiling or a wall. The securing plates 35 are located outside of the baffling plate 37 and the driving circuit module 33.

Each of the guiding plates 20 is a bended metal plate to substantially construct a Z-shaped configuration. Each guiding plate 20 comprises an elongated body 22, a top flange 24 and a bottom flange 26 respectively perpendicularly extending from top and bottom edges of the body 22 along opposite directions. The two top flanges 24 of the two guiding plates 20 horizontally extend towards the LED assemblies 40 to be oriented towards each other. The two bottom flanges 26 of the two guiding plates 20 each horizontally extend outwards away from the LED assemblies 40. The bottom flanges 26 and top flanges 24 are parallel to each other. The two bottom flanges 26 of the two guiding plates 20 are respectively welded to two opposite sides of a top surface of the mounting plate 31 of the bracket 30. The openings 312 of the mounting plate 31 of the bracket 30 are located between the two bottom flanges 26 of the guiding plates 20. Right and left ends of the guiding plates 20 rest on the driving circuit module 33 and the baffling plate 37 of the bracket 30, respectively.

Figure 4:
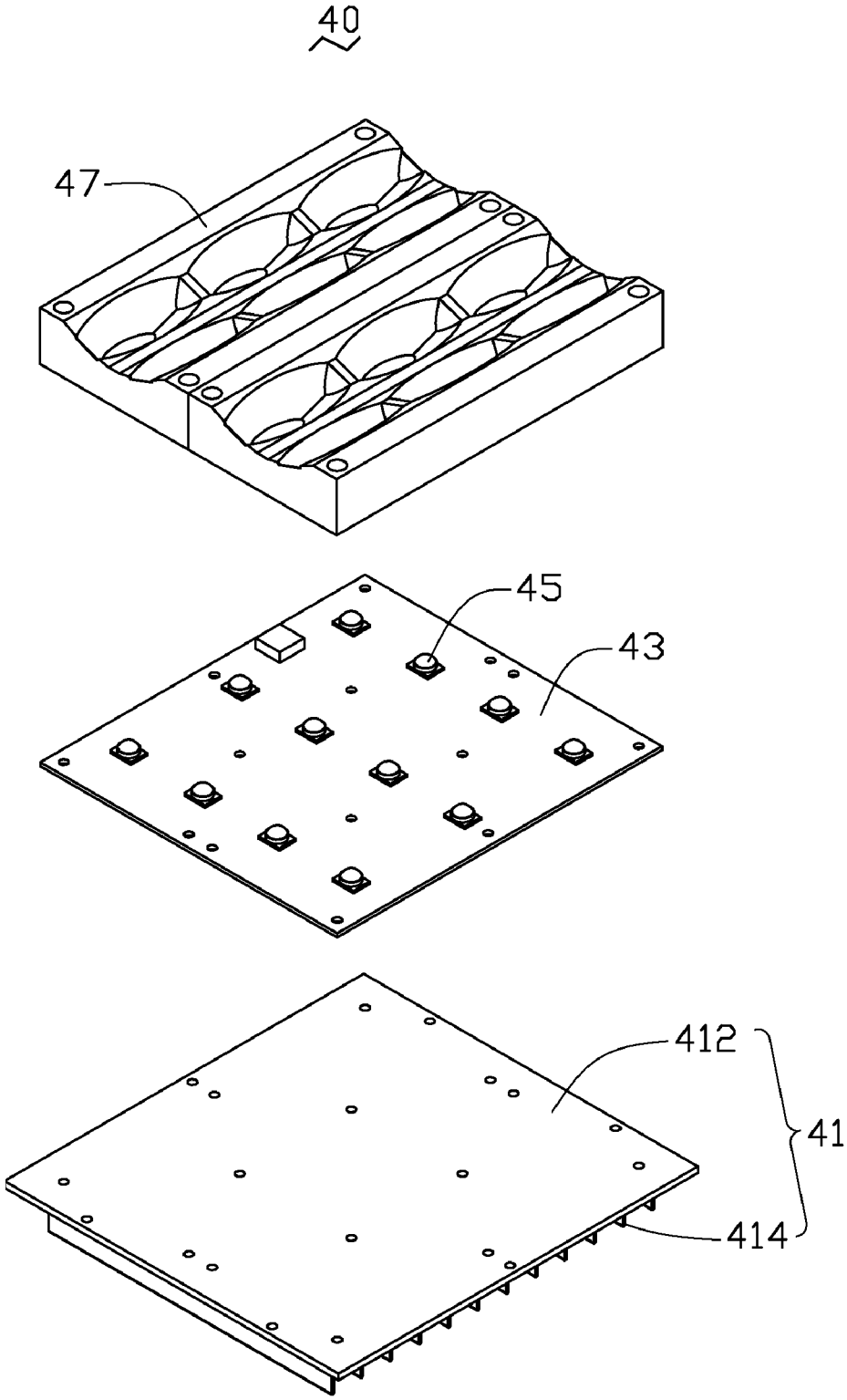
FIG. 4 is an exploded view of an LED assembly of the LED lamp in FIG. 3.

Referring to FIG. 4 also, each of the LED assemblies 40 comprises a heat sink 41, a printed circuit board 43 mounted on the heat sink 41, a number of LED modules 45 mounted on the printed circuit board 43 and a reflector 47 mounted on the printed circuit board 43 and covering the LED modules 45. The heat sink 41 comprises a rectangular base 412 and a number of fins 414 extending upwardly from a center portion of a top surface of the base 412. The fins 414 are parallel to and spaced from each other. A length of each of the fins 414 approaches a distance between the two top flanges 24 of the two guiding plates 20. A length of the base 412 approaches a distance between the two bodies 22 of the two guiding plates 20. A height from the top surface of the base 412 of the heat sink 41 to a bottom surface of the reflector 47 of the LED assembly 40 approaches a height from a bottom surface of the top flange 24 of the guiding plate 20 to the top surface of the mounting plate 31 of the bracket 30.

Figure 5:
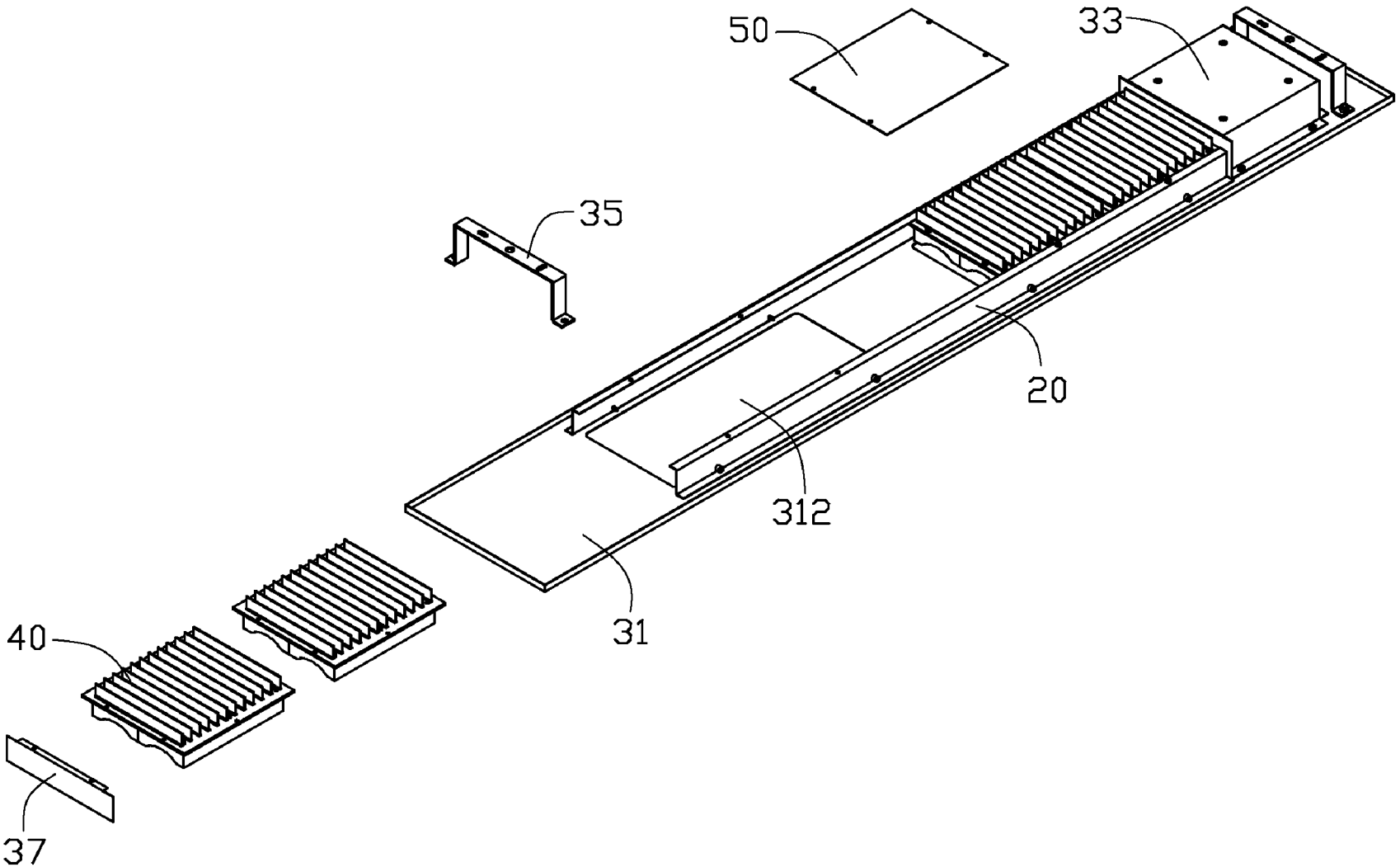
FIG. 5 is another exploded view of the LED lamp in FIG. 1.

Referring to FIGS. 1-2 and FIG. 5, in assembly, the driving circuit module 33 is mounted on the mounting plate 31 of the bracket 30. The two bottom flanges 26 of the two guiding plates 20 are welded on the two opposite sides of the top surface of the mounting plate 31 of the bracket 30. The right ends of the guiding plates 20 abut against a left side of the driving circuit module 33. Two adjacent LED assemblies 40 are sandwiched between the guiding plates 20. The two adjacent LED assemblies 40 slide towards the driving circuit module 33 along a longitudinal direction of the guiding plates 20 until the base 412 of a right one of the heat sinks 41 of the LED assembly 40 rests on the driving circuit module 33. A number of screws 60 extends through the top flanges 24 of the guiding plates 20 and engages with bases 412 of the heat sinks 41 of the LED assemblies 40. A number of screws 70 extends through the bodies 22 of the guiding plates 20 and engages with the bases 412 of the heat sinks 41 of the LED assemblies 40. Thus, the two adjacent LED assemblies 40 and the guiding plates 20 are assembled together, and the two adjacent LED assemblies 40 are mounted on the bracket 30. Another two adjacent LED assemblies 40 are mounted on the guiding plates 20 by a similar manner. The another two adjacent LED assemblies 40 are oriented towards the opening 312 which is located at the left end of the mounting plate 31 of the bracket 30. In this state, each two adjacent LED assemblies 40 are oriented towards the corresponding opening 312 of the mounting plate 31 of the bracket 30. The bottom ends of the LED assemblies 40 are exposed to the corresponding openings 312. The LED modules 45 and the reflectors 47 are entirely located in a room between the top flanges 24 and the mounting plate 31. The reflectors 47 rest on the mounting plate 31. The bases 412 of the heat sinks 41 of the LED assemblies 40 are sandwiched between the bodies 22 of the guiding plates 20 and blocked under the top flanges 24. The bases 412 are located under the top flanges 24. The fins 414 of the heat sinks 41 of the LED assemblies 40 are sandwiched between the top flanges 24 of the guiding plates 20. The fins 414 extend upwardly beyond the top flanges 24 of the guiding plates 20.

The rectangular plate 50 is located at a center portion of a top of the top flanges 24 of the guiding plates 20 and sandwiched between the two groups of the LED assemblies 40. Screws 80 extend through the rectangular plate 50 and engage with the LED assemblies 40 to assemble the LED assemblies 40 and the rectangular plate 50 together. The baffling plate 37 is fixed to the left ends of the guiding plates 20. The securing plates 35 are mounted on the lateral edges of the mounting plate 31. The cover 10 is adhered to the bottom face of the bracket 30 and covers the four LED assemblies 40. Thus, the LED lamp is assembled together.

In this embodiment, the number of the LED assemblies 40 can be changed to meet different luminous intensity requirements/specifications when the LED assemblies 40 are mounted to the openings 312 of the mounting plate 31 of the bracket 30. In the above embodiment, there are four LED assemblies mounted on the LED lamp; however, for a half intensity, the LED lamp can be easily mounted with two LED assemblies only, without unfavorably altering the appearance of the LED lamp.

Figure 6:
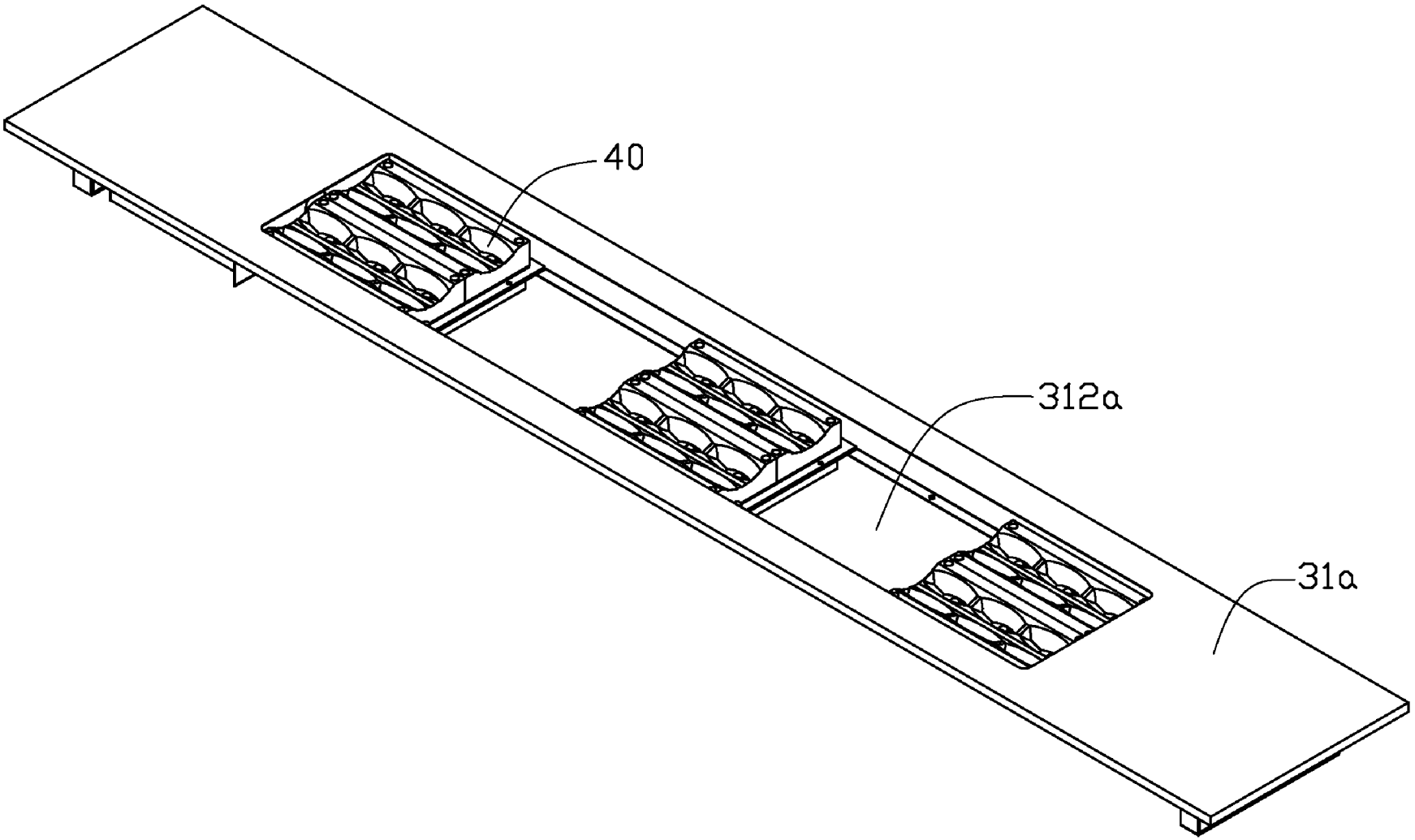
FIG. 6 is an assembled view of an LED lamp in accordance with a second embodiment of the disclosure.

Referring to FIG. 6, an LED lamp of a second embodiment of the present disclosure is disclosed. Difference between the first and second embodiments is that an elongated opening 312*a* is defined at a center portion of a mounting plate 31*a* to replace the two openings 312 in the mounting plate 31 of the first embodiment. Three LED assemblies 40 are equidistantly received in the opening 312*a* in a lengthwise direction of the guiding plates 20. In use, the number of the LED assemblies 40 can be changed to meet different luminous intensity requirements/specifications.

It is believed that the present embodiments and their advantages will be understood from the foregoing description, and it will be apparent that various changes may be made thereto without departing from the spirit and scope of the disclosure or sacrificing all of its material advantages, the examples hereinbefore described merely being preferred or exemplary embodiments of the disclosure.

What is claimed is:

1. An LED lamp comprising:

a bracket;

two guiding plates mounted to two opposite sides of a top face of the bracket, each of the guiding plates comprising a body, a top flange and a bottom flange extending from top and bottom edges of the body respectively, the bottom flanges being secured on the two opposite sides of the top face of the bracket and spaced from each other, the top flanges oriented towards each other;

a baffling member and a driving circuit module mounted on opposite ends of the bracket and resisting on opposite ends of the guiding plates to sandwich the guiding plates therebetween; and a plurality of LED assemblies each comprising a plurality of LED modules, the LED assemblies being mounted to the bracket for radiating light downwardly, each of the LED assemblies being sandwiched between the bodies of the guiding plates, wherein each of the LED assemblies slides along a longitudinal direction of and between the guiding plates before the each of the LED assemblies is secured to the guiding plates to be assembled to the bracket.

2. The LED lamp as claimed in claim 1, wherein the two bottom flanges are oriented in opposite directions.

3. The LED lamp as claimed in claim 1, wherein a distance between the bodies of the guiding plates approaches a length of one of the LED assemblies.

4. The LED lamp as claimed in claim 1, wherein each of the LED assemblies further comprises a heat sink and a printed circuit board mounted on the heat sink, the number of LED modules being mounted on the printed circuit board, the heat sink being sandwiched between the bodies of the guiding plates.

5. The LED lamp as claimed in claim 4, wherein the heat sink of each of the LED assemblies comprises a base and a number of fins extending upwardly from a center portion of a top face of the base, the base being sandwiched between the bodies of the guiding plates, the fins being sandwiched between the top flanges of the guiding plates.

6. The LED lamp as claimed in claim 5, wherein the base of the heat sink is blocked under bottom sides of the top flanges of the guiding plates, and the fins of the heat sink extend upwardly beyond the top flanges of the guiding plates.

7. The LED lamp as claimed in claim 5, wherein a length of the base of the heat sink approaches a distance between the bodies of the guiding plates, and a length of each the fins of the heat sink approaches a distance between the top flanges of the guiding plates.

8. The LED lamp as claimed in claim 7, wherein a plurality of screws extends through the bodies and top flanges of the guiding plates and engages with the bases of the heat sinks of the LED assemblies to secure the LED assemblies to the guiding plates.

9. The LED lamp as claimed in claim 1, wherein two spaced openings are defined in the bracket, and the LED modules of the LED assemblies are oriented towards the two openings so that light generated by the LED modules can radiate downwardly through the openings.

10. The LED lamp as claimed in claim 1, wherein an elongated opening is defined at a center portion of the bracket, and the LED modules of the LED assemblies are oriented towards the opening so that light generated by the LED modules can radiate downwardly through the opening.

11. The LED lamp as claimed in claim 1, wherein two securing plates are mounted on lateral ends of the bracket to mount the LED lamp on a determined place.

12. The LED lamp as claimed in claim 1, wherein each of the guiding plates has a substantially Z-shaped configuration.

13. An LED lamp, comprising:

a bracket;

two guiding plates mounted to two opposite sides of a top face of the bracket, each of the guiding plates comprising a body, a top flange and a bottom flange extending from top and bottom edges of the body respectively, the bottom flanges being secured on the two opposite sides of the top face of the bracket and spaced from each other, the top flanges oriented towards each other; and a plurality of LED assemblies for radiating light downwardly, the plurality of LED assemblies being mounted to the bracket and sandwiched between the bodies of the guiding plates, wherein each LED assembly slides along a longitudinal direction of and between the guiding plates before secured to the guiding plates to be assembled to the bracket, the plurality of LED assemblies each comprise a heat sink, a printed circuit board mounted on the heat sink and a plurality of LED modules mounted on the printed circuit board, the heat sink of each LED assembly is sandwiched between the bodies of the guiding plates and comprises a base and a number of fins extending upwardly from a center portion of a top face of the base, the base of the heat sink is blocked under bottom sides of the top flanges of the guiding plates, and the fins of the heat sink extend upwardly beyond the top flanges of the guiding plates.

14. An LED lamp, comprising:

a bracket;

two guiding plates mounted to two opposite sides of a top face of the bracket, each of the guiding plates comprising a body, a top flange and a bottom flange extending from top and bottom edges of the body respectively, the bottom flanges being secured on the two opposite sides of the top face of the bracket and spaced from each other, the top flanges oriented towards each other; and a plurality of LED assemblies for radiating light downwardly, the plurality of LED assemblies being mounted to the bracket and sandwiched between the bodies of the guiding plates, wherein each of the LED assemblies slides along a longitudinal direction of and between the guiding plates before the each of the LED assemblies is secured to the guiding plates to be assembled to the bracket, the plurality of LED assemblies each comprising a heat sink, a printed circuit board mounted on the heat sink and a plurality of LED modules mounted on the printed circuit board, the heat sink comprises a base and a number of fins extending upwardly from a center portion of a top face of the base, the base being sandwiched between the bodies of the guiding plates, the fins being sandwiched between the top flanges of the guiding plates, a length of the base approaches a distance between the bodies of the guiding plates, and a length of each the fins of the heat sink approaches a distance between the top flanges of the guiding plates, a plurality of screws extends through the bodies and top flanges of the guiding plates and engages with the bases of the heat sinks of the LED assemblies to secure the LED assemblies to the guiding plates.

* * * * *